US005177456A

United States Patent [19]

Stern et al.

[11] Patent Number: 5,177,456

[45] Date of Patent: Jan. 5, 1993

[54] MICROSTRIP FERRITE CIRCULATOR FOR SUBSTRATE TRANSITIONING

[75] Inventors: Richard A. Stern, Allenwood; Richard W. Babbitt, Fair Haven, both of N.J.

[73] Assignee: The United States of America as represented by the Secretary of the Army, Washington, D.C.

[21] Appl. No.: 887,029

[22] Filed: May 22, 1992

[51] Int. Cl.[5] ..... H01P 1/387

[52] U.S. Cl. ..... 333/1.1; 333/24.1

[58] Field of Search ..... 333/1.1, 24.1, 24.2

[56] References Cited

U.S. PATENT DOCUMENTS

| | | | |
|---|---|---|---|
| 3,968,457 | 7/1976 | Desormiere | 333/1.1 |
| 4,745,377 | 5/1988 | Stern et al. | 333/26 |
| 4,749,966 | 6/1988 | Stern et al. | 333/1.1 |
| 4,754,237 | 6/1988 | Stern et al. | 333/1.1 |
| 4,806,886 | 2/1989 | Stern et al. | 333/24.2 |

FOREIGN PATENT DOCUMENTS

| | | | |
|---|---|---|---|
| 240101 | 10/1988 | Japan | 333/1.1 |

*Primary Examiner*—Paul Gensler

*Attorney, Agent, or Firm*—Michael Zelenka; William H. Anderson

[57] ABSTRACT

A transitioning microstrip circulator. A Y-shaped circulator having two ports coupled to a first planar substrate and a third port coupled to a second planar substrate. The first and second planar substrates are substantially parallel and have the circulator sandwiched between them. The circulator selectively directs a millimeter wave signal along a millimeter wave transmission line to a selected port. Thereby, a signal can be coupled to circuit elements placed on each substrate. Circuit elements placed on the first and second substrate are stacked one on top of the other. This permits design flexibility and smaller packages for electronic devices.

6 Claims, 2 Drawing Sheets

MICROSTRIP FERRITE CIRCULATOR FOR SUBSTRATE TRANSITIONING

STATEMENT OF GOVERNMENT RIGHTS

The invention described herein may be manufactured, used, and licensed by or for the government for governmental purposes without the payment to us of any royalties thereon.

BACKGROUND OF THE INVENTION

1. Field of the Invention

This invention relates generally to microstrip Y-junction circulators, and particularly to a circulator providing transitioning between circuit elements on different substrates.

2. Description of the Prior Art

Circulators have multiple ports which provide signal transmission from one port to an adjacent port while decoupling the signal from the other ports. Y-junction circulators have three ports. Circulators are used in many electronic systems for selectively directing a signal to various circuit elements. For example, they are used in radar systems as duplexers to couple the transmitter and receiver to a single radar antenna. They are also used in many other applications such as signal generator protection circuits, and transmitter injection locking circuits as an example. The use of planar geometry circuitry in conjunction with microstrip transmission lines in the millimeter wave frequency applications has resulted in reductions in size and weight of the circuit elements. An example of a planar geometry microstrip circulator is found in U.S. Pat. No. 4,749,966 entitled "Millimeter Wave Microstrip Circulator" issuing Jun. 7, 1988 to Stern et al, the inventors of the present invention, which is herein incorporated by reference. With the increasing use and number of components fabricated with the planar type geometry, the cost of manufacturing and assembly have been reduced, as well as the physical size of the resulting package of circuit elements. However, there is a continuing need to further decrease the number of circuit elements and the physical size of the circuit elements. Additionally, the planar geometry of the microstrip circuit elements has resulted in difficulties of packaging and transitioning of the circuit elements to provide a compact package. Therefore, there is a need to improve the packaging and assembly of microstrip circuit elements.

SUMMARY OF THE INVENTION

A Y-shaped ferrite circulator is sandwiched between a first and second substrate such that a signal can selectively be circulated between either substrate. The Y-shaped ferrite circulator is comprised of three ports. Each port has the shape of a thin prism extending radially from a central point. Two ports are coupled to the first substrate and the other port is coupled to the second substrate parallel to the first substrate. A biasing magnetic field is used to selectively direct a signal through any desired port and then along a microstrip to a circuit element.

Accordingly, it is an object of the present invention to provide a circulating and transitioning function in a single circuit element.

It is an advantage of the present invention that microstrip circuit complexity is reduced.

It is a further advantage of the present invention that overall size of the device is reduced.

It is a feature of the present invention that the circulator is sandwiched between two substrates containing different circuit elements.

It is another feature of the present invention that one of the ports is positioned to couple with a second substrate.

DETAILED DESCRIPTION OF THE PREFERRED EMBODIMENT

Figure 1:
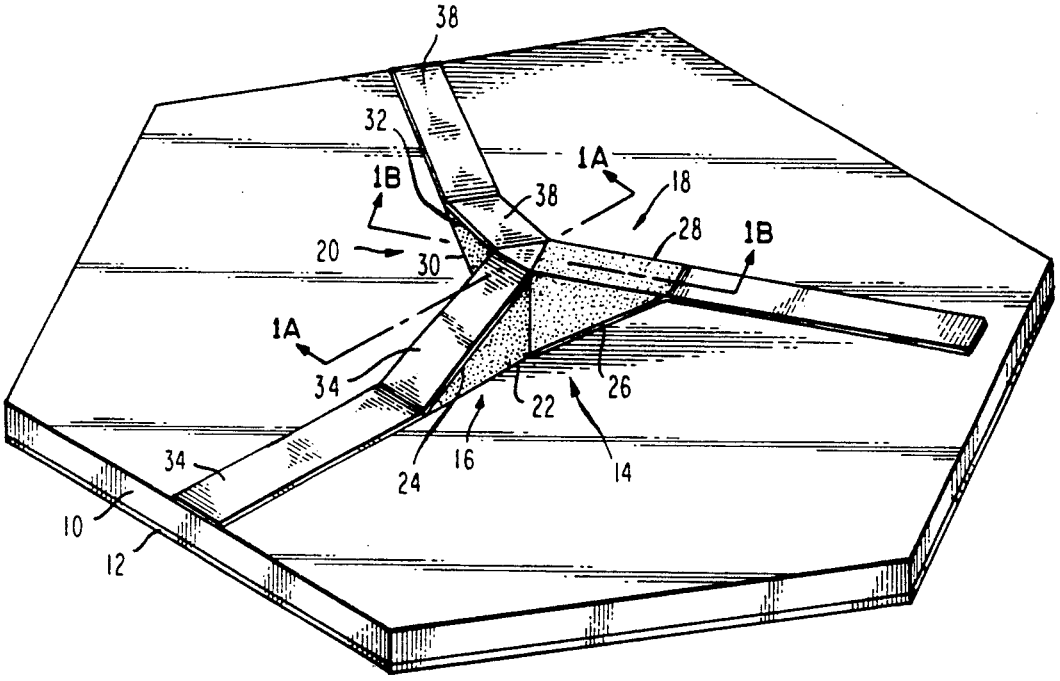
FIG. 1 is a perspective view of a portion of the present invention.

FIG. 1 illustrates a portion of the present invention. First substrate 10 has a planar top surface and a planar bottom surface. Substrate 10 comprises a section of conventional microstrip transmission line substrate which is usually fabricated of Duroid, or other similar dielectric material having a relatively low dielectric constant. Duroid is a product of Rogers Corporation consisting of woven glass/PTFE laminates. On the bottom surface of substrate 10 is a conductive ground plane 12 which is fabricated of a good conductor such as copper or silver.

A Y-shaped ferrite element, indicated generally as 14, is mounted on the top surface of substrate 10. Y-shaped ferrite element 14 is fabricated of a ferrite material such as nickel, zinc, or lithium ferrite, or any other material which exhibits gyromagnetic behavior in the presence of a unidirectional magnetic field. The ferrite element 14 is illustrated as a monolithic structure, however the ferrite element 14 need not be a monolithic structure. The ferrite element 14 is comprised of a first port 16, a second port 18, and a third port 20. Each of the first, second, and third ports 16, 18, and 20 have the shape of a thin prism. The first, second, and third ports 16, 18, and 20, extend radially from a central point forming a Y-shape. Each port has a longitudinal cross-section of substantially a right triangle. First port 16 has a bottom surface or first leg 22 adjacent the substrate 10. The first port 16 has a top surface or hypotenuse 24. The top surface or hypotenuse 24 is covered with microstrip 34. Microstrip 34 is a conventional microstrip material and is electrically conductive. The microstrip 34 can be applied to the ferrite element 14 by sputtering, or similar techniques. The second port 18 has a bottom surface or a hypotenuse 26, and a top surface or first leg 28. The third port 20 has a bottom surface or first leg 30, and a top surface or hypotenuse 32. Deposited on top surface 32 is a microstrip 38.

Figure 1A:
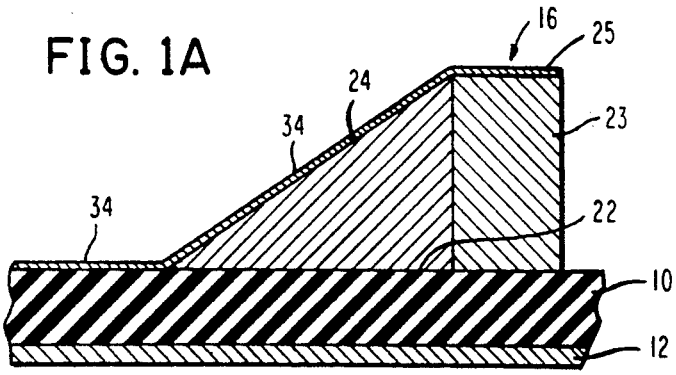
FIG. 1A is a partial cross section taken along line 1A—1A in FIG. 1.
Figure 1B:
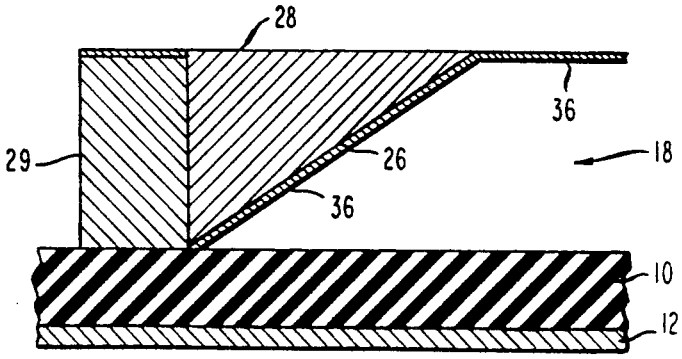
FIG. 1B is a partial cross section taken along line 1B—1B in FIG. 1.

FIGS. 1A and 1B more clearly illustrate the cross section of the first port 16 and the second port 18. In FIG. 1A, the first port 16 has a generally triangular cross section. There is a small flat portion 25 at the top of the first port 16. The small flat section 25 represents the area formed at the central portion or junction of the Y-shaped ferrite element 14. The central portion of the Y-shaped ferrite element 14 is more fully described in U.S. Pat. No. 4,749,966 referenced above. Adjacent the small flat section 25 is a second leg 23. Second leg 23 and first leg 22 form a right angle.

FIG. 1B illustrates a longitudinal cross section of the second port 18. The second port 18 is oriented with its hypotenuse 26 facing the top surface of substrate 10. A second leg 29 is substantially perpendicular to the top planar surface of substrate 10. At a right angle thereto is the first leg 28. On the bottom surface or hypotenuse 26 is placed a microstrip 36.

Figure 2:
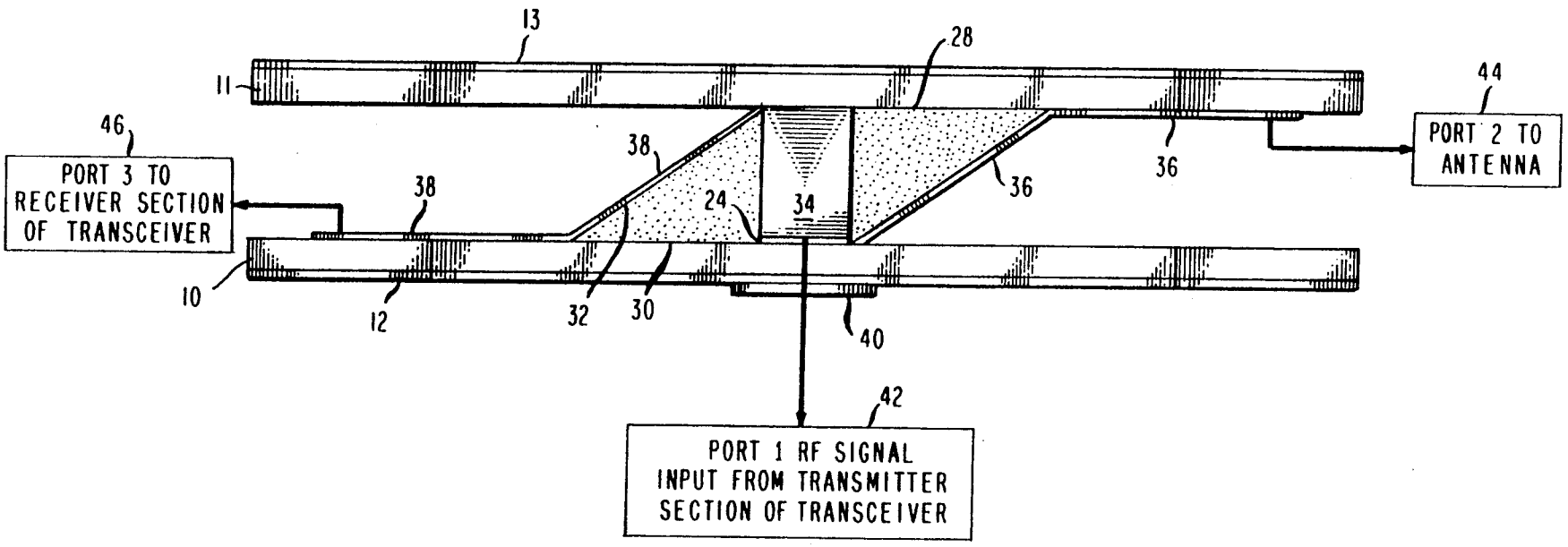
FIG. 2 is a partial front elevational view and schematic illustrating the present invention.

FIG. 2 illustrates the present invention as contemplated. A first substrate 10 has placed thereon a first port 16, second port 18, and third port 20. The first, second, and third ports 16, 18, and 20 are as illustrated in FIGS. 1, 1A, 1B. A second substrate 11 is positioned on top of and substantially parallel to the first substrate 10. The first, second, and third ports 16, 18, and 20 are positioned between the first substrate 10 and the second substrate 11. A second ground plane 13 is formed on the top surface of second substrate 11. Second substrate 11 is additionally made of a microstrip transmission line substrate, such as Duroid or other similar dielectric material having a relatively low dielectric constant. Beneath the junction of the first, second, and third ports 16, 18, and 20 is a biasing magnet 40. Biasing magnet 40 can be a permanent magnet or any means for providing a unidirectional magnetic field. The central portion of ferrite element 14 in conjunction with the applied unidirectional magnetic field from biasing magnet 40 acts as a ferrite circulator with respect to electromagnetic wave energy. The operation of a ferrite circulator of this type is more fully described in U.S. Pat. No. 4,415,871 issuing Nov. 15, 1983 to the inventors of the present invention, and assigned to the assignee of the present invention, herein incorporated by reference.

A microstrip leads to each port 16, 18, and 20. The microstrip leading to the ports 16, 18, and 20 in combination with substrate 10 and 11, and ground planes 12 and 13 form a separate microstrip transmission line which is easily coupled to the microstrip transmission lines of other planar circuits. These other circuits are selectively coupled by the microstrip circulator of the present invention. The ports 16, 18, and 20 of ferrite element 14 act as transitions between the substrates 10 and 11, and the central portion of the ferrite element 14. The dielectric constant of ferrite element 14 is usually higher than the dielectric constant of the material comprising microstrip substrate 10 and 11. Therefore, when millimeter wave signals are applied to the microstrip, they are captured by the ferrite material of the central portion of ferrite element 14.

The present invention as illustrated and described acts as a circulator and permits transitioning between adjacent parallel substrates. As a result, substrates can be stacked providing compact packaging of circuit elements. For example, as illustrated in FIG. 2, a transceiver is fabricated on substrate 10. RF signal input means represented by box 42 is applied to the first port 16 by a transmitter section of a transceiver. A receiver illustrated by box 46 is coupled to the third port 20 to a receiving section of the transceiver. The transceiver is conveniently fabricate on the planar surface of substrate 10. An antenna means illustrated by box 44 is coupled to the second port 18. The antenna means represented by box 44 is conveniently fabricated on the planar surface of second substrate 11. By selectively circulating a signal between the three ports 16, 18, and 20, the transmitter and receiver share the common antenna. Additionally, because of the transitioning between a first and second planar substrate, a single large planar surface having large dimensions is avoided. The device is therefore made smaller and in a more convenient package. Therefore, the transitioning circulator of the present invention has many practical applications.

Although the preferred embodiment has been illustrated and described, it will be obvious to those skilled in the art that various modifications may be made without departing from the spirit and scope of this invention.

What is claimed is:

1. A microstrip transitioning circulator comprising:

a first planar dielectric substrate;

a ferrite element mounted on said first substrate, said ferrite element having a first substrate port and a second substrate port, the first substrate port and the second substrate port each having a longitudinal cross-section of substantially a right triangle with a hypotenuse, and a first and second leg separated by an angle of substantially 90 degrees;

a second planar dielectric substrate substantially parallel with said first substrate and having said ferrite element therebetween, the first substrate port having its first leg adjacent said first substrate and its second leg adjacent the second substrate port, said second substrate port having its first leg adjacent said second substrate and its second leg adjacent the first substrate port;

a first microstrip placed on said first substrate and the hypotenuse of the first substrate port;

a second microstrip placed on said second substrate and the hypotenuse of the second substrate port; and biasing magnetic field means, coupled to a portion of the first substrate port and the second substrate port, for providing a magnetic field, whereby a signal is circulated between the first substrate port and the second substrate port.

2. A microstrip transitioning circulator comprising:

a first planar dielectric substrate;

a Y-shaped ferrite element mounted on said first substrate, said Y-shaped ferrite element having a first port, second port, and third port, each of the first, second, and third ports having a longitudinal cross section of substantially a right triangle with a hypotenuse, and a first and second leg separated by an angle of substantially 90 degrees;

a second planar dielectric substrate substantially parallel with said first substrate and having said Y-shaped ferrite element between said first and second substrate, the first port having its first leg adjacent said first substrate and its second leg adjacent the second and third port, the second port having its first leg adjacent said second substrate and its second leg adjacent the first and third ports, the third port having its first leg adjacent said first substrate and its second leg adjacent the first and second ports;

a first microstrip placed on said first substrate and the hypotenuse of the first port;

a second microstrip placed on said second substrate and the hypotenuse of the second port;

a third microstrip placed on said first substrate and the hypotenuse of the third port; and biasing magnetic field means, coupled to a portion of the first, second, and third ports for providing a magnetic field, whereby a signal is circulated between the first, second, and third ports.

3. A microstrip transitioning circulator as in claim 2 wherein:

said biasing magnetic field means provides a unidirectional magnetic field.

4. A microstrip transitioning circulator as in claim 3 wherein:

said biasing magnetic field means is a permanent magnet.

5. A microstrip transitioning circulator as in claim 2 further comprising:

a transmitter coupled to the first port;

a receiver coupled to the third port; and an antenna coupled to the second port.

6. A microstrip transitioning circulator comprising:

a first planar dielectric substrate;

a second planar dielectric substrate a ferrite element mounted between said first and second substrates, said ferrite element having at least a first and second port, the first and second ports each having a longitudinal cross-section of substantially a triangular shape and having at least a top surface and a bottom surface, the first port having its bottom surface adjacent said first substrate and the second port having its bottom surface adjacent said second substrate;

at least a first and second microstrip, the first microstrip placed on said first substrate and the top surface of the first port, and the second microstrip placed on said second substrate and the top surface of the second port; and biasing magnetic field means for providing a magnetic field, the biasing magnetic field means being coupled to said ferrite element.

* * * * *